US009205646B2

(12) United States Patent
Fujii

(10) Patent No.: US 9,205,646 B2
(45) Date of Patent: Dec. 8, 2015

(54) LIQUID DISCHARGING SUBSTRATE, LIQUID DISCHARGING HEAD, AND RECORDING APPARATUS

(71) Applicant: CANON KABUSHIKI KAISHA, Tokyo (JP)

(72) Inventor: Kazunari Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/706,737

(22) Filed: May 7, 2015

(65) Prior Publication Data

US 2015/0321471 A1 Nov. 12, 2015

(30) Foreign Application Priority Data

May 9, 2014 (JP) ..... 2014-097770

(51) Int. Cl.
*B41J 2/14* (2006.01)
*B41J 2/16* (2006.01)
*B41J 2/045* (2006.01)

(52) U.S. Cl.
CPC ..... *B41J 2/04541* (2013.01); *B41J 2/04586* (2013.01); *B41J 2/14072* (2013.01)

(58) Field of Classification Search
CPC .... B41J 2/04541; B41J 2/0458; B41J 2/0455; B41J 2/04588; B41J 2/04543; B41J 2/04523; B41J 2/04586
See application file for complete search history.

(56) References Cited

U.S. PATENT DOCUMENTS

2005/0264608 A1* 12/2005 Hirayama ..... 347/54

FOREIGN PATENT DOCUMENTS

| | | | |
|---|---|---|---|
| JP | 2000-108355 | A | 4/2000 |
| JP | 2005-104142 | A | 4/2005 |
| JP | 2005-138428 | A | 6/2005 |
| JP | 2011-213049 | A | 10/2011 |

* cited by examiner

*Primary Examiner* — Juanita D Jackson
(74) *Attorney, Agent, or Firm* — Canon U.S.A., Inc. IP Division

(57) ABSTRACT

A liquid discharging substrate includes multiple heaters and multiple drive elements. A first wiring portion electrically connects the multiple heaters and a first electrode. A second wiring portion electrically connects the multiple drive elements and a second electrode. The first wiring portion includes multiple conductive members. The conductive members are connected to the first electrode and respective heaters. An insulating portion is disposed between each of the conductive members. The second wiring portion includes a common conductive member connected to the multiple drive elements and the second electrode.

20 Claims, 11 Drawing Sheets

LIQUID DISCHARGING SUBSTRATE, LIQUID DISCHARGING HEAD, AND RECORDING APPARATUS

BACKGROUND OF THE INVENTION

1. Field of the Invention

The present invention relates to a liquid discharging substrate, a liquid discharging head, and a recording apparatus.

2. Description of the Related Art

As of recent, discharging elements which discharge liquid such as ink or the like are used as recording elements in recording apparatuses. Japanese Patent Laid-Open No. 2005-104142 discloses a liquid discharging substrate which has multiple heaters as discharging elements. The multiple heaters are arrayed having been divided into multiple segments, each including two or more heaters. This liquid discharging substrate has wiring to supply power source voltage to the heaters provided to each individual segment. In the same way, wiring to supply ground voltage to the heaters is provided to each individual segment. This structure enables variance in energy supplied to the heaters to be reduced.

Japanese Patent Laid-Open No. 2005-138428 discloses a liquid discharging substrate which has multiple heaters as discharging elements. This liquid discharging substrate has wiring to supply power source voltage to the heaters and wiring to supply ground voltage to the heaters each provided in common to multiple heaters. This structure enables wiring resistance to be reduced, and energy to be supplied to the heaters efficiently.

SUMMARY OF THE INVENTION

A liquid discharging substrate includes: a plurality of discharging elements arranged along a first direction; a plurality of drive elements that drive the plurality of discharging elements; a first electrode to which a first voltage is supplied; a second electrode to which a second voltage, different from the first voltage, is supplied; a first wiring portion electrically connecting the first electrode and the plurality of discharging elements; and a second wiring portion electrically connecting the second electrode and the plurality of drive elements. The plurality of discharging elements include a first discharging element and a second discharging element, and the plurality of drive elements include a first drive element electrically connected to the first discharging element, and a second drive element electrically connected to the second discharging element. The first wiring portion includes a first conductive member electrically connected to the first electrode and the first discharging element, and a second conductive member electrically connected to the first electrode and the second discharging element. An insulating portion is formed between at least part of the first conductive member and at least part of the second conductive member. The second wiring portion includes a common conductive member, which extends along a row of the plurality of discharge elements, and which is electrically connected to the second electrode, the first drive element, and the second drive element. A length of the second conductive member in the first direction is longer than a length of the first conductive member in the first direction, and a resistance value of the second conductive member is smaller than a resistance value of the first conductive member.

Further features of the present invention will become apparent from the following description of exemplary embodiments with reference to the attached drawings.

DESCRIPTION OF THE EMBODIMENTS

According to some embodiments, both improved discharging accuracy of a liquid discharging substrate and low-voltage driving can be realized.

The wiring structure disclosed in Japanese Patent Laid-Open No. 2005-104142 is advantageous in improving discharging accuracy of the liquid discharging substrate, but on the other hand, has a large wiring resistance. If voltage drop on the wiring is large, energy supplied to the heaters becomes small. Particularly, a large voltage drop on wiring connected to driving elements to drive the heaters makes controlling of the discharge elements at low voltage difficult. Thus, there is a problem in that driving a liquid discharging substrate at low voltage is difficult.

On the other hand, the wiring structure disclosed in Japanese Patent Laid-Open No. 2005-138428 is advantageous regarding low-voltage driving of the liquid discharging substrate, but on the other hand, variance in energy supplied to the heaters is great. Thus, there is a problem that variance occurs in discharge properties, and consequently, discharge accuracy deteriorates.

In this way, improved discharge accuracy and low-voltage driving have been in a trade-off relationship in liquid discharging substrates. Some embodiments provide a liquid discharging substrate realizing both improved discharging accuracy of a liquid discharging substrate and low-voltage driving.

One form by which the present invention is carried out is a liquid discharging substrate having discharging elements that discharge liquid such as ink or the like. Another form by which the present invention is carried out is a liquid discharging head including a liquid discharging substrate and a liquid supply unit which supplies liquid such as ink or the like to the liquid discharging substrate. The liquid discharging head is used as a recording head of a recording apparatus, for example. Yet another form by which the present invention is carried out is a recording apparatus having a liquid discharging head and a driving unit to drive the liquid discharging head. The recording apparatus is a printer or copier, for example. Alternatively, the liquid discharging substrate according to one form of the present invention may be applied to a device for manufacturing three-dimensional structures, DNA chips, organic transistors, color filters, or the like.

Figure 1:
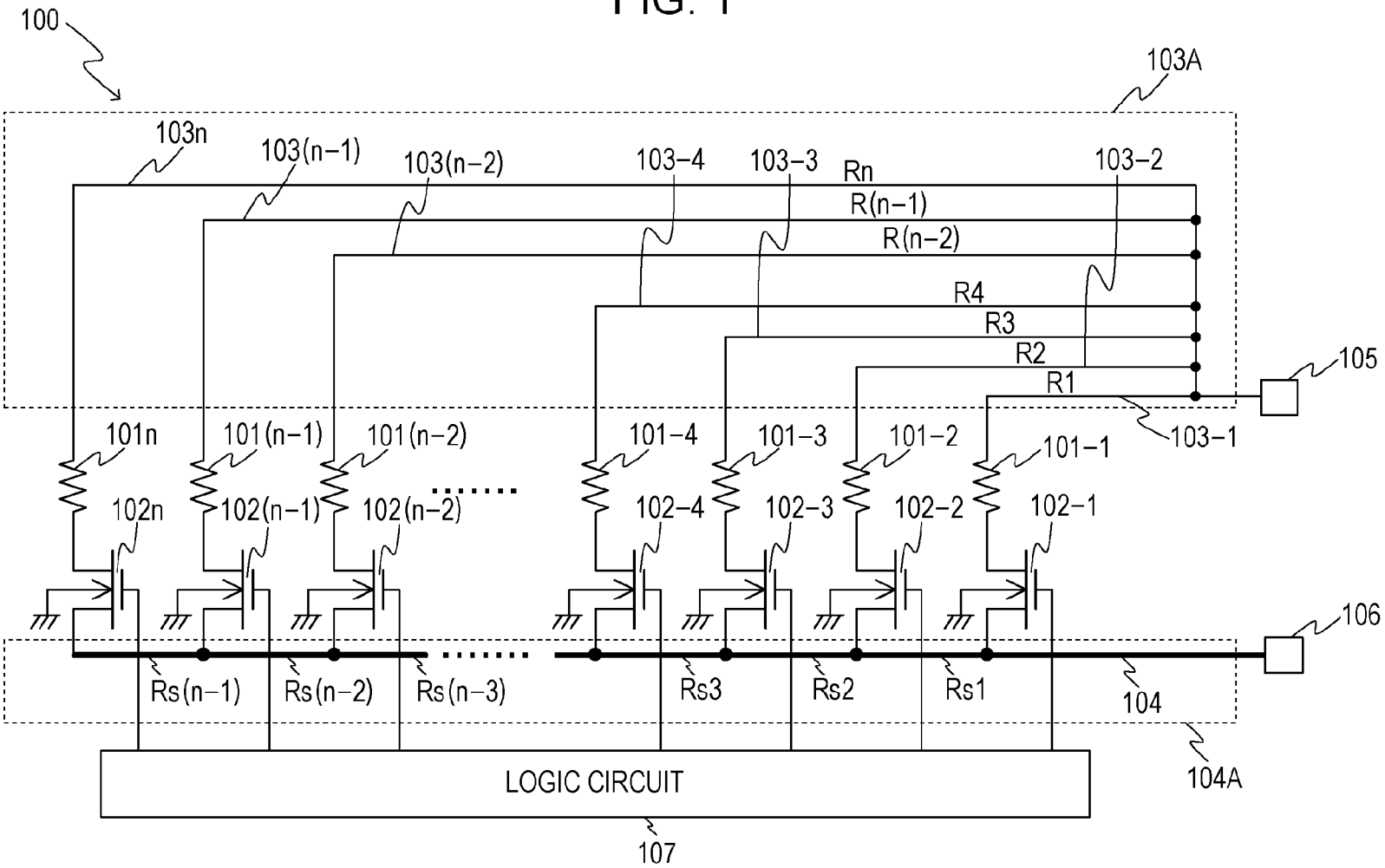
FIG. 1 is an equivalent circuit diagram illustrating the configuration of a liquid discharging substrate.

Multiple discharging elements are arrayed on a liquid discharging substrate. The discharging elements are provided with elements to convert electric energy into energy to discharge the liquid, such as heaters, piezoelectric elements, and so forth. FIG. 1 illustrates an example of heaters 101 as an example of discharging elements.

Multiple drive elements are provided corresponding to the multiple discharging elements. FIG. 1 illustrates drive elements 102. Transistors, for example, are used as the driving elements. The driving elements supply the corresponding discharging elements with electric energy, based on control signals.

The liquid discharging substrate includes a first electrode to which a first voltage is supplied, and a second electrode to which a second voltage is supplied. FIG. 1 exemplarily illustrates a first electrode 105 and second electrode 106. The first voltage is a power source voltage, for example. The second voltage is a ground voltage, for example. The first electrode and second electrode may be pads which are externally connected from the liquid discharging substrate by wire bonding or the like.

A first wiring portion electrically connects the first electrode and the multiple discharging elements. A second wiring portion electrically connects the second electrode and the multiple drive elements. FIG. 1 exemplarily illustrates a first wiring portion 103A and a second wiring portion 104A.

Figure 2:
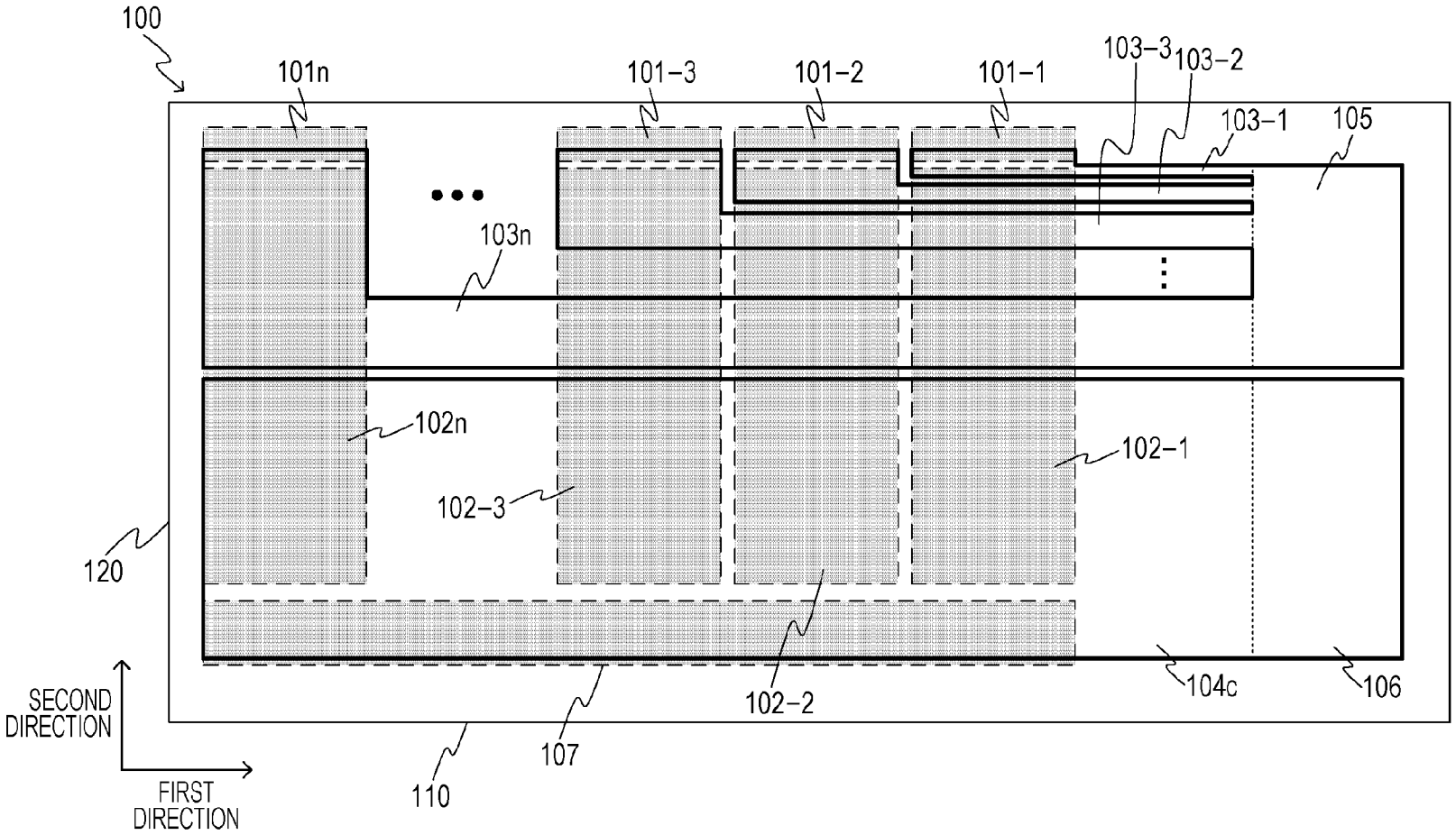
FIG. 2 is a diagram schematically illustrating the planar configuration of the liquid discharging substrate.

The first wiring portion includes multiple conductive members. FIG. 2 exemplarily illustrates multiple conductive members 103-1 through **103-*n***. The multiple conductive members are each electrically connected to different discharging elements. Insulating members such as interlayer insulating film or the like are disposed between these conductive members. Accordingly, each of the multiple discharging elements is electrically connected to the first electrode by an individual conductive member.

The second wiring portion includes a common conductive member, connected to the multiple drive elements. FIG. 2 exemplarily illustrates a common conductive member 104. The multiple drive elements are electrically connected to the second electrode via the common conductive member. The common conductive member is the portion of the wiring from the drive elements to the second electrode which extends following the rows of discharging elements.

As described above, each of the discharging elements is connected to the first electrode from which the first voltage is supplied, by an individual line. Accordingly, the variance in energy supplied to the discharging elements can be reduced. On the other hand, the multiple drive elements are connected to the second electrode from which the second voltage is supplied by the common wiring. Accordingly, the resistance of the wiring from the second electrode to the multiple drive elements can be reduced. Accordingly, both improved discharging accuracy of the liquid discharging substrate and low-voltage driving of the liquid discharging substrate can be realized by the present embodiment.

The second wiring portion connecting the drive elements and the second electrode include the common conductive member in the present embodiment. Accordingly, the voltage drop from the second electrode to the drive elements can be reduced. As a result, the drive elements can be controlled using signals with small amplitude. In this case, the configuration including the common conductive member in the second wiring portion yields additional advantages, such as being able to use a common power source for the power source of a circuit which supplies control signals and the power source of circuits which operate under low voltage, such as a logic circuit and so forth.

Embodiments of the present invention will be described below with reference to the drawings. Of course, the embodiments of the present invention are not restricted just to the embodiments described below. For example, an example where a partial configuration of one of the embodiments below is added to a different embodiment, and an example where a partial configuration of one of the embodiments is substituted for a partial configuration of a different embodiment, are embodiments according to the present invention as well.

First Embodiment

A first embodiment will be described. FIG. 1 is an equivalent circuit diagram illustrating the configuration of a liquid discharging substrate 100.

The liquid discharging substrate 100 includes multiple heaters 101 which are discharging elements. In the present embodiment, n heaters 101, from the 1st heater 101-1 to the n'th heater **101*n***, are arrayed. This n is any natural number.

When referring to an individual heater in the present specification, notation will be made as a combination of a common reference numeral and a number representing that heater. For example, heater 101-1 indicates the 1st heater from the right in FIG. 1. On the other hand, when describing matters common to multiple heaters in a collective manner, only the common reference numeral will be used. Notation will be similarly performed for elements and circuits other than the heaters 101 as well.

One terminal of the heater 101 is connected to the first electrode 105 where power source voltage is supplied, via a first wiring portion 103A. The other terminal of the heater 101 is connected to corresponding drive element 102. The drive element 102 is connected to the second electrode 106 where the ground voltage is supplied, via the second wiring portion 104A. The first electrode 105 and the second electrode 106 are pads connected to external devices, for example.

The drive element 102 functions as a switch controlling driving of the heater 101. The drive element 102 drives the heater 101 based on control signals. Specifically, when the drive element 102 conducts electricity, current flows to the heater 101, and the heater 101 generates heat. The drive element 102 is an N-type metal-oxide semiconductor (MOS) transistor. The drain is connected to the heater 101, and the source is grounded. The back gate of the MOS transistor is grounded. A large amount of energy can be supplied to the heater 101 by using a MOS transistor with high voltage withstanding capabilities, such as a double-diffused metal-oxide-semiconductor (DMOS).

Control signals are supplied to the drive element 102 from a logic circuit 107. The logic circuit 107 controls the conducting state of the drive element 102. The logic circuit 107 is, for example, a shift register which receives recording data that is externally input. The power source voltage of the logic circuit 107 is 3.3 V. The control signals which the logic circuit 107 outputs are signals including at least the two values of 0 V and 3.3 V. The logic circuit 107 may be omitted in an embodiment where all heaters 101 are driven at all times.

Each of the multiple heaters 101 is electrically connected to the first electrode 105 by an individual line. Specifically, the first wiring portion 103A includes multiple conducting members 103. A conducting member 103-1 is connected to a heater 101-1 and the first electrode 105. A conducting member 103-2 is connected to a heater 101-2 and the first electrode 105. In the same way, conducting members 103-3 through **103*n* are respectively connected to heaters 101-3 through 101*n*, and the first electrode 105**.

The multiple drive elements 102 are electrically connected to the second electrode 106 by common wiring. Specifically, the second wiring portion 104A includes the common conducting member 104. The common conducting member 104 is connected to each of the multiple drive elements 102 and to the second electrode 106.

Next, the planar configuration of the liquid discharging substrate 100 will be described. FIG. 2 is a diagram schematically illustrating the planar configuration of the liquid discharging substrate 100. Portions which have the same functions as those in FIG. 1 are denoted by the same reference numerals.

The liquid discharging substrate 100 includes a semiconductor substrate such as silicon or the like. The liquid discharging substrate 100 has a first side 110 following a first direction, and a second side 120, following a second direction which intersects with the first direction. The second side 120 is shorter than the first side 110.

The multiple heaters 101 are arranged along the first direction. The row of the multiple heaters 101 in FIG. 2 is a straight line, but the row of the multiple heaters 101 is not restricted to being a straight line. Multiple drive elements 102 are arranged along the first direction, corresponding to the multiple heaters 101. The multiple heaters 101, multiple drive elements 102, and logic circuit 107, are arranged along the second direction.

A region where the drive elements 102 are disposed in FIG. 2 has circuits disposed to drive the heaters 101, such as a level converter circuit, voltage generating circuit, buffer circuit, logic gate circuit, and so forth, besides the transistor serving as switches.

The multiple conducting members 103, common conducting member 104, first electrode 105, and second electrode 106, are included in a wiring layer formed on the semiconductor substrate. The multiple conducting members 103 and the first electrode 105 are a wiring pattern integrally formed at one wiring layer. The common conducting member 104 and second electrode 106 are a wiring pattern integrally formed at one wiring layer. Note that in another embodiment, the multiple conducting members 103 and the first electrode 105 are formed on different wiring layers, and connected to each other by plugs. In the same way, the common conducting member 104 and second electrode 106 are formed on different wiring layers, and connected to each other by a plug. The multiple conducting members 103 and the common conducting member 104 are included in the same wiring layer in the present embodiment. In another embodiment, the multiple conducting members 103 and the common conducting member 104 are included in different wiring layers.

The multiple conducting members 103 extend in parallel with the row of the multiple heaters 101. The conducting member 103-1 is connected to the heater 101-1 via a contact plug which is omitted from illustration. The conducting member 103-2 is connected to the heater 101-2 via a contact plug which is omitted from illustration. In the same way, the conducting members 103-3 through **103*n* are connected to the heaters 101-3 through 101*n* via a contact plugs which are omitted from illustration. Insulating members such as interlayer insulating film or the like are disposed between adjacent conducting members 103. According to this configuration, each of the multiple heaters 101 is electrically connected to the first electrode 105** by an individual line.

The common conducting member 104 extends in parallel with the row of the multiple heaters 101. The common conducting member 104 is connected to the multiple drive elements 102 by contact plugs which are omitted from illustration. Specifically, a first portion of the common conducting member 104, disposed above a region where a drive element 102-1 is situated, is electrically connected to the drive element 102-1 via a contact plug omitted from illustration. A second portion of the common conducting member 104 disposed above a region where a drive element 102-2 is disposed, is electrically connected to the drive element 102-2 via a contact plug omitted from illustration. In the same way, third through n'th portions of the common conducting member 104 disposed above regions where drive elements 102-3 through **102*n* are disposed, are electrically connected to the drive elements 102-3 through 102*n* via contact plugs omitted from illustration. The second portion of the common conducting member 104 is electrically connected to the second electrode 106 via the first portion. The third portion of the common conducting member 104 is electrically connected to the second electrode 106 via the first portion and second portion. The n'th portion of the common conducting member 104 is electrically connected to the second electrode 106 via the first portion through (n−1)'th portion. According to this configuration, the multiple drive elements 102 are electrically connected to the second electrode 106** via the common wiring.

Note that an intermediate wiring layer may be disposed between the conducting members 103 and the heaters 101. In this case, the conducting members 103 and the heaters 101 are connected by the conducting member including in this intermediate wiring layer. In the same way, an intermediate wiring layer may be disposed between the common conducting member 104 and the drive elements 102. In this case, the common conducting member 104 and the drive elements 102 are connected by the conducting member including in this intermediate wiring layer. The intermediate wiring layer may also include a conducting member connecting the heaters 101 and the drive elements 102, or the like.

Now, the difference in structure between the multiple conducting members 103 and the common conducting member 104 will be described. The lengths of the multiple conducting members 103 in the first direction are different from each other. For example, the length of the conducting member 103-2 in the first direction is longer than the length of the conducting member 103-1 in the first direction. In the same way, the length of the conducting member 103-3 in the first direction is longer than the length of the conducting member 103-2 in the first direction. The length of the conducting member **103*n*** in the first direction is the longest in the present embodiment.

The width of the multiple conducting members 103 differs in the second direction. By changing the width of the multiple conducting members 103, the resistance values of the multiple conducting members 103 can be set independent from each other. Accordingly, difference in wiring resistance among the multiple heaters 101 can be reduced. As a result, variance in energy supplied to the heaters 101 can be reduced.

For example, the drive element **102*n* is situated the farthest from the second electrode 106 of all drive elements 102. Accordingly, the voltage drop due to the common conducting member 104 is great for the current flowing through the drive element 102*n* to the heater 101*n*, as compared to current flowing through the other drive elements 102 to the corresponding heaters 101. Accordingly, the voltage drop at the conducting member 103*n* is made to be smaller than the voltage drop at the other conducting members 103 by making the resistance value Rn of the conducting member 103*n* to be smaller. Accordingly, the difference in voltage applied to both ends of the heater 101*n* and voltage applied to both ends of the other heaters 101 can be reduced. That is to say, variance in energy supplied to the multiple heaters 101** can be reduced.

On the other hand, in a case of providing individual lines, there is the need to secure space for the multiple conducting members, and space to separate these conducting members, within a limited area. Accordingly the resistance of each line tends to be high. In a case where increase in the number of heaters calls for a greater number of lines, the increase in resistance of the wiring becomes even more marked.

With regard to this point, the common conducting member 104 extends following the row of multiple heaters 101 in the present embodiment, as illustrated in FIG. 2. The multiple drive elements 102 and the second electrode 106 are connected by the common conducting member 104. Accordingly, the common conducting member 104 can be easily made wider, and the resistance value of the common conducting member 104 can be reduced as compared to a case of providing individual lines. Reducing the resistance from the second electrode 106 to the drive elements 102 enables loss of energy supplied to the heater to be reduced. As a result, the liquid discharging apparatus can be driven at low voltage.

Also, the rise in the source potential of the drive elements 102 can be reduced according to the present embodiment, so the voltage between the gate and source can be increased. This means that an even larger drain current can be supplied to the heaters 101. Consequently, the discharge performance of the liquid discharging apparatus can be improved.

Alternatively, the drive elements 102 can be controlled by signals with smaller amplitude according to the present embodiment. Accordingly, a common power source can be used for the power source of the logic circuit 107 which supplies control signals and the power source of other logic circuits. Fewer power source voltages being used does away with the need for level conversion circuits or the like, and the size of the apparatus can be reduced. Thus, according to the present embodiment, the apparatus using the liquid discharging substrate can be reduced in size.

This effect will be described. In the embodiment illustrated in FIG. 1, power source voltage is supplied to the first electrode 105, and ground voltage (0 V) is supplied to the second electrode 106. The threshold voltage of the transistors making up the drive elements 102 is Vth. The voltage drop at the common conducting member 104 at the time of driving the heater 101*n* is Vloss.

In this case, signals having amplitude from at 0 V to at least a voltage higher than Vth+Vloss are used for the control signals. The reason is that low voltage near 0 V is needed to turn the drive element 102-1 closest to the second electrode 106 off, while on the other hand voltage higher than Vth+Vloss is necessary to turn the drive element 102*n* farthest from the second electrode 106 on.

The smaller the resistance of the common conducting member 104 is, the smaller the voltage drop Vloss at the common conducting member 104 can be made. Accordingly, signals with a smaller amplitude can be used as control signals.

Also, the second side 120 is shorter than the first side 110. The first electrode 105 and second electrode 106 are arrayed following the second side 120, as illustrated in FIG. 2. In such a configuration where the electrodes to which voltage is supplied are arrayed toward the second side 120, the multiple conducting members 103 and the common conducting member 104 tend to become long. Accordingly, wiring resistance may increase, or difference in wiring resistance may become great among the multiple heaters 101. Thus, the effects of improving discharge accuracy and reducing voltage, due to having used the individual lines and common line according to the present embodiment are even more notable.

Next, the resistance values of the multiple conducting members 103 and the common conducting member 104 will be described. As illustrated in FIG. 1, the conducting member 103-1 has a resistance value R1. The conducting member 103-2 has a resistance value R2. In the same way, the conducting members 103-3 through 103*n* have resistance values R3 through Rn.

As described above, the resistance values of the multiple conducting members 103 can be set independent from each other. For example, the resistance values R1 through Rn of the multiple conducting members 103-1 through 103*n* can be set progressively larger to where R1<R2< . . . <Rn. Using this relationship enables the area of the first wiring portion 103A to be reduced. On the other hand, the resistance values R1 through Rn of the multiple conducting members 103-1 through 103*n* can be made to be the same where R1=R2= . . . =Rn. This relationship may be used in a case where the resistance of the common conducting member 104 is low. Alternatively, the resistance values R1 through Rn of the multiple conducting members 103-1 through 103*n* can be set progressively smaller to where R1>R2> . . . >Rn. This relationship may be used in a case where the first electrode 105 and the second electrode 106 are disposed on one side of the liquid discharging substrate 100, such as illustrated in FIG. 2. The effects of improved discharge accuracy are high when the resistance values R1 through Rn of the multiple conducting members 103-1 through 103*n* satisfy the relationship in the following Expression (1).

$$R1 \geq R2 \geq \ldots R(n-1) \geq Rn \quad (1)$$

The common conducting member 104 includes multiple portions to connect two adjacent drive elements 102. A portion situated between the drive element 102-1 and the drive element 102-2 have a resistance value Rs1. A portion situated between the drive element 102-2 and the drive element 102-3 have a resistance value Rs2. In the same way, a portion situated between the drive element 102(*n*−1) and the drive element 102*n* have a resistance value Rs(n−1).

Rs1=Rs2= . . . =Rs(n−1) holds in the present embodiment. A relationship of Rs1≠Rs2≠ . . . ≠Rs(n−1) may be formed by changing the width of the common conducting member 104 and the position of plugs connecting to the drive elements 102.

In some embodiments, the resistance values R1 through Rn of the multiple conducting members 103-1 through 103*n* satisfy the relationship of the following Expression (2). The effects of these embodiments will be described quantitatively below.

$$R1 = R2 = \ldots = R(n-1) = Rn \quad (2)$$

The number of heaters 101 will be described as being eight, to simplify description. The current I applied to one heater 101 is 50 mA. The heater 101-1, heater 101-2, . . . , and heater 101-8, are arrayed in order from the side close to the first electrode 105. The resistance values R1 through R8 of the multiple conducting members 103-1 through 103-8 are each 14Ω. The resistance of the common conducting member 104 is such that the resistance values Rs1 through Rs(n−1) at portions between adjacent drive elements 102 is 0.3Ω at each.

In a comparative example, the multiple heaters 101 are connected to the first electrode 105 via common wiring. In the comparative example, the resistance value Rf of wiring between adjacent heaters on the common wiring connecting the multiple heaters 101 and the first electrode 105 is 0.3Ω at each.

Figure 3A:
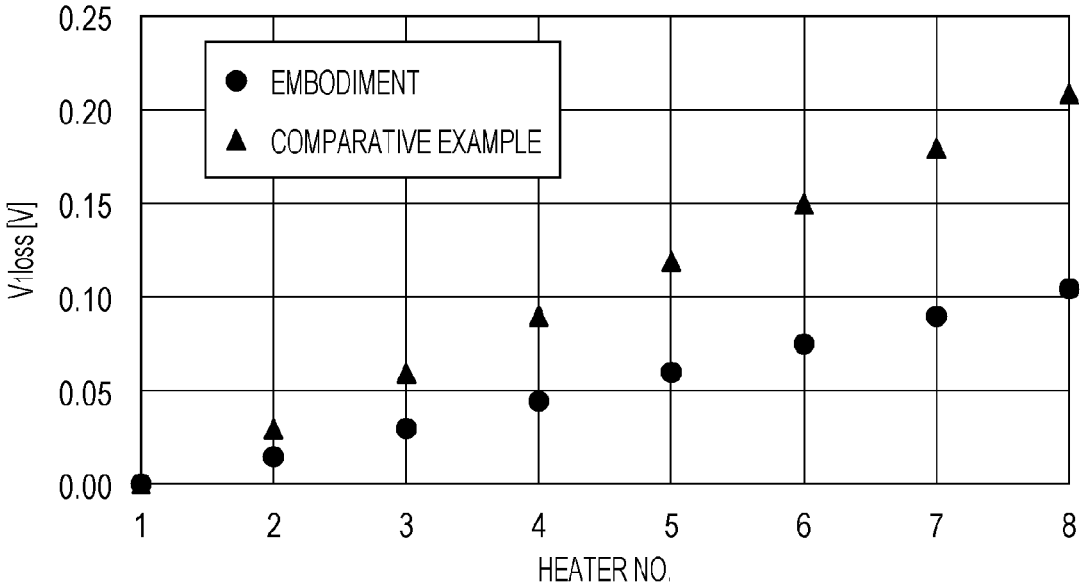
FIGS. 3A and 3B are diagrams illustrating logical values of voltage loss at the liquid discharging substrate.

FIG. 3A is a graph illustrating voltage drop occurring due to difference in wiring resistance when a heater 101 is driven alone, i.e., voltage loss Vloss. The horizontal axis represents the No. of the heater 101 being driven. The vertical axis represents voltage drop due to the wiring, i.e., the voltage loss Vloss. The voltage loss Vloss when driving the heater 101-1, i.e., 0 V, is used as the reference.

In FIG. 3A, the plotted points represented by the dots indicate the logical values according to the present embodiment. The voltage loss Vloss at the k'th heater 101*k* is found by the following Expression (3).

$$Vloss_k = I \times (k-1) \times Rs \quad (3)$$

The voltage loss Vloss1 due to the conducting member 103-1 and the common conducting member 104 when the heater 101-1 is driven is (Rf+Rs0)×I. However, this voltage loss Vloss1 is used as a reference and accordingly is represented as 0 V in FIG. 3A.

The plotted points represented by the triangles in FIG. 3A indicate the logical values according to the comparative example. The voltage loss Vloss at the k'th heater is found by the following Expression (4).

$$Vloss_k = I \times (k-1) \times (Rf+Rs) \quad (4)$$

As illustrated in FIG. 3A, the highest value in difference of voltage loss Vloss among the multiple heaters 101 is 0.210 V in the comparative example, and 0.105 V in the present embodiment. Accordingly, the highest value in difference of voltage loss Vloss among the multiple heaters 101 can be halved as compared to the comparative example.

Figure 3B:
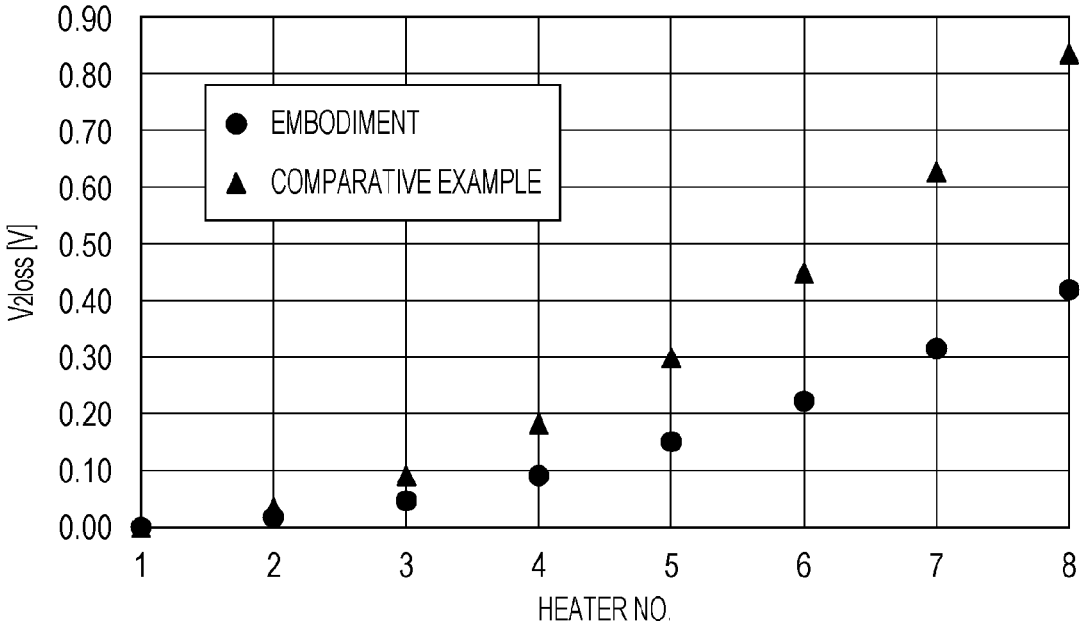

FIG. 3B is a graph illustrating voltage loss Vloss at the conducting member 103*k* connected to the k'th heater 101*k* and the common conducting member 104, occurring due to difference in wiring resistance when the multiple heaters 101-1 through 101*k* are driven at the same time. The 3 on the horizontal axis in FIG. 3B represents, for example, voltage loss Vloss at the conducting member 103-3 connected to the heater 101-3 and the common conducting member 104 when three heaters 101-1 through 101-3 are driven at the same time. The reference for the voltage loss Vloss is a case of driving the heater 101-1 alone, i.e., 0 V. The configuration of the embodiment and comparative example, and the conditions of current and resistance values, are the same as in FIG. 3A.

In FIG. 3B, the plotted points represented by the dots indicate the logical values according to the present embodiment. The voltage loss Vloss at the k'th heater is found by the following Expression (5).

$$Vloss_k = \tfrac{1}{2} \times I \times k \times (k-1) \times Rs \quad (5)$$

The plotted points represented by the triangles in FIG. 3B indicate the logical values according to the comparative example. The voltage loss Vloss at the k'th heater is found by the following Expression (6).

$$Vloss_k = \tfrac{1}{2} \times I \times k \times (k-1) \times (Rf+Rs) \quad (6)$$

As illustrated in FIG. 3B, the highest value in difference of voltage loss Vloss among the multiple heaters 101 is 0.84 V in the comparative example, and 0.42 V in the present embodiment. Accordingly, he highest value in difference of voltage loss Vloss among the multiple heaters 101 can be halved as compared to the comparative example.

According to the present embodiment as described above, variance in voltage loss due to the position of the heater 101 being driven, and the number of heaters 101 being driven at the same time, can be reduced. Accordingly, more stable energy can be supplied to the heaters 101, and discharge accuracy can be improved. In a case where the resistance values R1 through Rn of the multiple conducting members 103-1 through 103*n* are R1>R2> . . . >Rn, variance in voltage loss can be reduced even further.

In some other embodiments, the resistance values R1 through Rn of the multiple conducting members 103-1 through 103*n* satisfy the relationship of R1>R2> . . . >Rn. Further, the resistance value Rs of the common conducting member 104 satisfies the relationship in the following Expression (7). The effects of these embodiments will be described quantitatively below.

$$\sum_{i=1}^{n-1} Rs_i < R1 - Rf < \sum_{i=1}^{n-1} (i \times Rs_i) \quad (7)$$

The number of heaters 101 will be described as being eight, to simplify description. The current I applied to one heater 101 is 50 mA. The heater 101-1, heater 101-2, . . . , and heater 101-8, are arrayed in order from the side close to the first electrode 105. The resistance of the common conducting member 104 is such that the resistance values Rs1 through Rs(n−1) at portions between adjacent drive elements 102 is 0.3Ω at each. In a case where the resistance values Rs are equal, Expression (7) is converted to the following Expression (8), where n=8.

$$(n-1) \times Rs < R1 - Rn < \tfrac{1}{2} \times n \times (n-1) \times Rs \quad (8)$$

The relationship between the resistance value R(k+1) of the k+1'th conducting member 103(*k*+1) and the resistance value Rk of the k'th conducting member 103*k* is as shown in the following Expression (9), where R1=15.2Ω and dR=0.4 Ω.

$$R(k+1) = Rk - dR \quad (9)$$

Figure 4A:
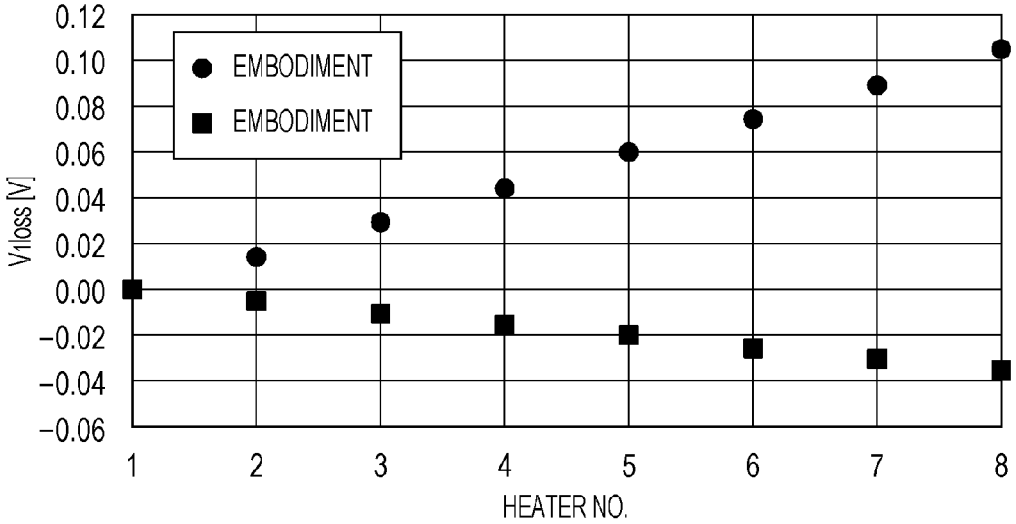
FIGS. 4A and 4B are diagrams illustrating logical values of voltage loss at the liquid discharging substrate.

FIG. 4A is a graph illustrating voltage loss Vloss occurring due to difference in wiring resistance when a heater 101 is driven alone. The horizontal axis represents the No. of the heater 101 being driven. The vertical axis represents voltage loss Vloss. The voltage loss Vloss when driving the heater 101-1, i.e., 0 V, is used as the reference.

In FIG. 4A, the plotted points represented by the dots indicate the logical values according to the embodiment illustrated in FIG. 3A. In FIG. 4A, the plotted points represented by the squares indicate the logical values according to the present embodiment. The voltage loss Vloss at the k'th heater 101*k* is found by the following Expression (10).

$$Vloss_k = I \times (k-1) \times (Rs - dR) \quad (10)$$

As illustrated in FIG. 4A, the highest value in difference of voltage loss Vloss among the multiple heaters 101 is 0.004 V in the present embodiment, and thus can be reduced by approximately 3% as compared to the embodiment in FIG. 3A.

Figure 4B:
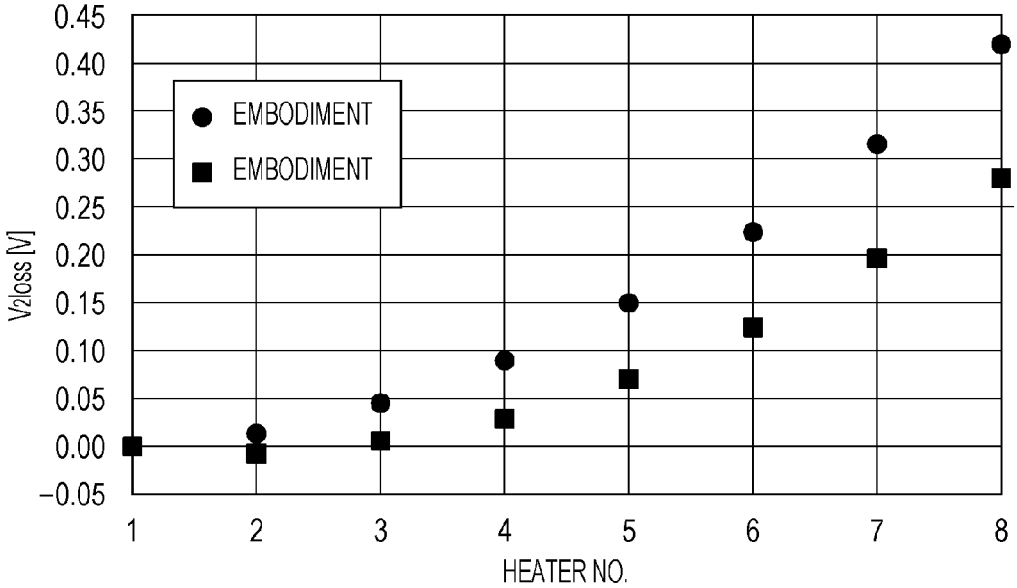

FIG. 4B is a graph illustrating voltage loss Vloss at the conducting member 103*k* connected to the k'th heater 101*k* and the common conducting member 104, occurring due to difference in wiring resistance when the multiple heaters 101-1 through 101*k* are driven at the same time. The 3 on the horizontal axis in FIG. 4B represents, for example, voltage loss Vloss at the conducting member 103-3 connected to the heater 101-3 and the common conducting member 104 when three heaters 101-1 through 101-3 are driven at the same time. The reference for the voltage loss Vloss is a case of driving the heater 101-1 alone, i.e., 0 V. The configuration of the embodiment and comparative example, and the conditions of current and resistance values, are the same as in FIG. 4A.

In FIG. 4B, the plotted points represented by the dots indicate the logical values according to the embodiment illustrated in FIG. 3B. In FIG. 4B, the plotted points represented by the squares indicate the logical values according to the present embodiment. The voltage loss Vloss at the k'th heater 101*k* is found by the following Expression (11).

$$Vloss_k = I \times (½ \times k \times (k-1) \times Rs - (k-1) \times dR) \quad (11)$$

As illustrated in FIG. 4B, the highest value in difference of voltage loss Vloss among the multiple heaters 101 is 0.285 V in the present embodiment, and thus can be reduced to approximately 68% as compared to the embodiment in FIG. 3B.

According to the present embodiment as described above, variance in voltage loss due to the position of the heater 101 being driven, and the number of heaters 101 being driven at the same time, can be reduced. Accordingly, more stable energy can be supplied to the heaters 101, and discharge accuracy can be improved.

Note that the left side in Expression (7) indicates conditions where all plotted points in FIG. 4A are 0 V. On the other hand, the right side in Expression (7) indicates conditions where all plotted points in FIG. 4B are 0 V. Accordingly, in both cases of driving a heater 101 individually and a case of driving multiple heaters 101 at the same time, variance in voltage loss can be reduced within the range of Expression (7), so discharge accuracy can be improved regardless of the driving conditions of the liquid discharging substrate. It should be noted that the parameters used in FIGS. 3A through 4B are only exemplary values, and are not restrictive in practice.

In the embodiment described above, power source voltage (e.g., 32 V) is supplied to the first electrode 105, and ground voltage (e.g., 0 V) is supplied to the second electrode 106. The drive elements 102 include N-type MOS transistors. In another embodiment, ground voltage (e.g., 0 V) is supplied to the first electrode 105, and power source voltage (e.g., 32 V) is supplied to the second electrode 106. In this case, the drive elements 102 include P-type MOS transistors. The drain is connected to the heaters 101, and the source is grounded. The back gate of the MOS transistor is supplied with power source voltage.

As described above, both improved discharging accuracy of the liquid discharging substrate and low-voltage driving of the liquid discharging substrate can be realized according to the present embodiment.

Second Embodiment

Another embodiment will be described. A feature of the present embodiment is that multiple heaters are arrayed having been divided into multiple segments, each including at least two heaters. Accordingly, only points which differ from the first embodiment will be described, and description of portions which are the same as the first embodiment will be omitted.

Figure 5:
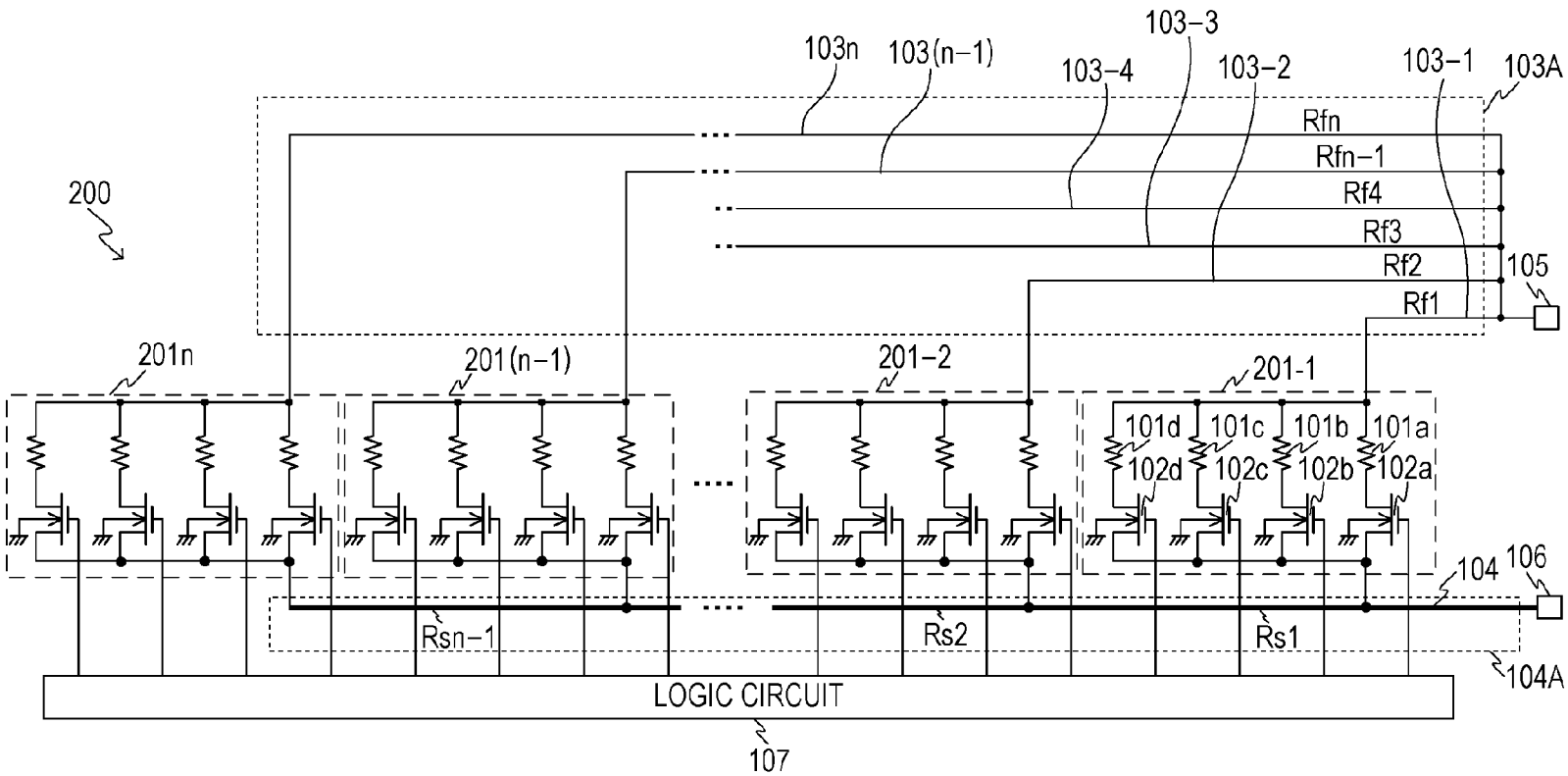
FIG. 5 is an equivalent circuit diagram illustrating the configuration of a liquid discharging substrate.

FIG. 5 is an equivalent circuit diagram illustrating the configuration of a liquid discharging substrate 200. Portions which have the same functions as those in FIG. 1 are denoted by the same reference numerals, and detailed description will be omitted.

The multiple heaters 101 are arrayed having been divided into multiple segments 201, each including four heaters 101. Alphabet characters will be added after the reference numerals to distinguish the heaters 101 included in a segment 201. For example, a segment 201-1 includes four heaters 101-*la* through 101-1*d*. Four drive elements 102*a* through 102*d* are disposed corresponding to the four heaters 101*a* through 101*d* included in one segment 201. The four heaters 101*a* through 101*d* included in one segment 201 are controlled by the logic circuit 107 in the same way as with the case of one heater 101 being driven independently.

Each of the multiple segments 201 are electrically connected to the first electrode 105 via a corresponding one of multiple conducting members 103. That is to say, the four heaters 101*a* through 101*d* included in one segment 201 are each electrically connected to one conducting member 103.

Figure 6:
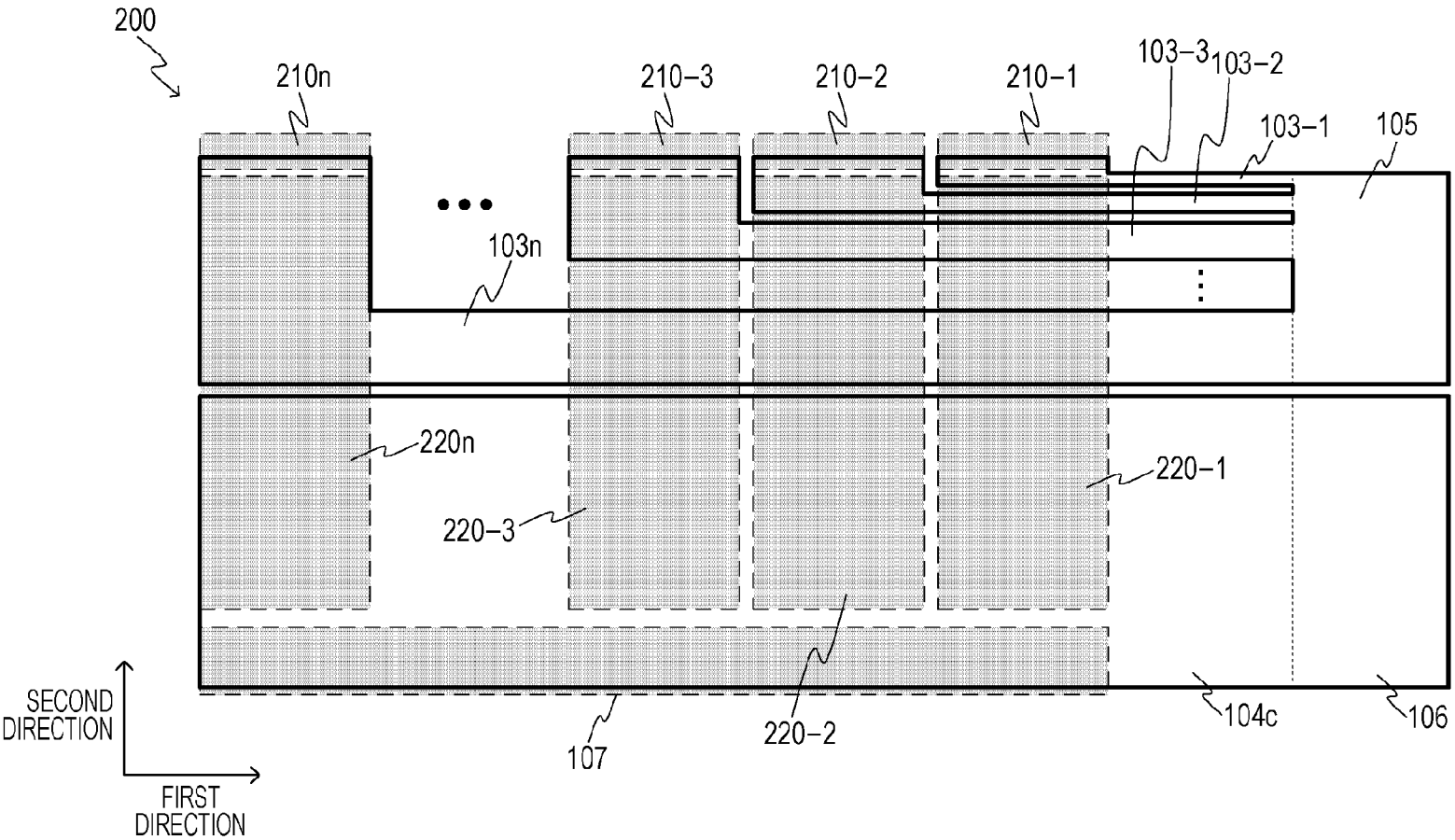
FIG. 6 is a diagram schematically illustrating the planar configuration of the liquid discharging substrate.

Next, the planar configuration of the liquid discharging substrate 200 will be described. FIG. 6 is a diagram schematically illustrating the planar configuration of the liquid discharging substrate 200. Portions which have the same functions as those in FIG. 1, 2, or 5, are denoted by the same reference numerals as those used in FIG. 5.

Multiple heaters 101 included in one segment 201 are arrayed in one heater region 210. Multiple heater regions 210 are arrayed along the first direction. The multiple drive elements 102 included in one segment 201 are arrayed in one drive element region 220. Description of layout within one segment will be omitted here.

One conducting member 103 is connected to multiple heaters 101 disposed in one heater region 210, via a contact plug omitted from illustration. Also, drive elements 102 of multiple segments 201 are connected to the common conducting member 104 via contact plugs omitted from illustration.

As described above, both improved discharging accuracy of the liquid discharging substrate and low-voltage driving of the liquid discharging substrate can be realized according to the present embodiment, in the same way as with the first embodiment.

Third Embodiment

Another embodiment will be described. The present embodiment differs from the second embodiment with regard to the placement of the first electrode and the second electrode. Accordingly, only points which differ from the first and second embodiments will be described, and description of portions which are the same as the first or second embodiments will be omitted.

The circuit arrangement of the present embodiment is the same as that in the second embodiment. That is to say, FIG. 5 is an equivalent circuit diagram illustrating the configuration of the present embodiment.

Figure 7:
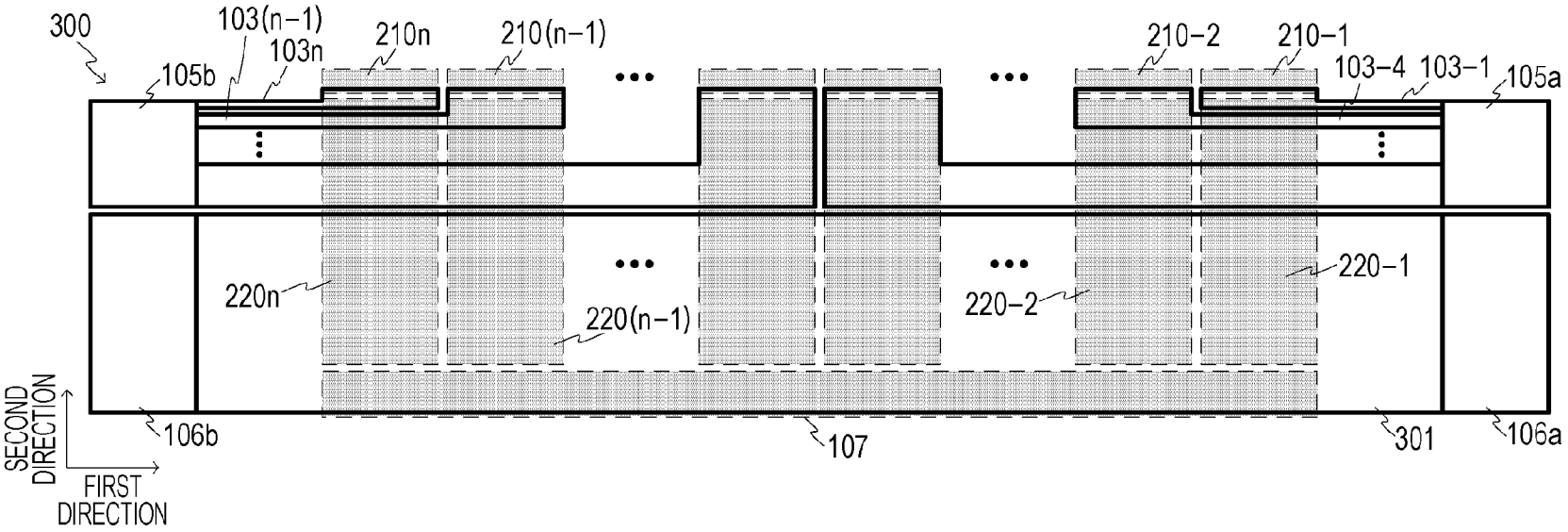
FIG. 7 is a diagram schematically illustrating the planar configuration of the liquid discharging substrate.

Next, the planar configuration of a liquid discharging substrate 300 will be described. FIG. 7 is a diagram schematically illustrating the planar configuration of the liquid discharging substrate 300. Portions which have the same functions as those in FIG. 1, 2, 5, or 6, are denoted by the same reference numerals.

Two first electrodes 105 are disposed on the liquid discharging substrate 300, one on either side, as illustrated in FIG. 7. Also, two second electrodes 106 are disposed on the liquid discharging substrate 300, one on either side. Multiple heater regions 210, multiple drive element regions 220, and the logic circuit 107 are disposed in the region between the two first electrodes 105 and in the region between the two second electrodes 106.

A part of the multiple conducting members 103 is connected to the first electrode 105*a* disposed at the right side. The other part of the multiple conducting members 103 is connected to the first electrode 105*b* disposed at the left side. This configuration enables the length of the conducting members 103 in the first direction to be reduced, and accordingly the resistance of the wiring to be reduced. Consequently, energy can be supplied to the heaters 101 in an efficient manner.

The second wiring portion 104A according to the present embodiment includes a common conducting member 301. The common conducting member 301 and the two second electrodes 106 are a wiring pattern integrally formed. This configuration enables the resistance of the common conducting member 301 to be reduced. Consequently, energy can be supplied to the heaters 101 in an efficient manner.

As described above, both improved discharging accuracy of the liquid discharging substrate and low-voltage driving of the liquid discharging substrate can be realized according to the present embodiment, in the same way as with the first embodiment. Particularly, energy can be efficiently provided to the heaters according to the present embodiment even the number of heaters is larger.

Fourth Embodiment

Another embodiment will be described. The present embodiment differs from the first through third embodiments with regard to the placement of the multiple heaters. Accordingly, only points which differ from the first through third embodiments will be described, and description of portions which are the same as the first through third embodiments will be omitted.

The circuit arrangement of the present embodiment is the same as that in the second embodiment. That is to say, FIG. 5 is an equivalent circuit diagram illustrating the configuration of the present embodiment.

Figure 8:
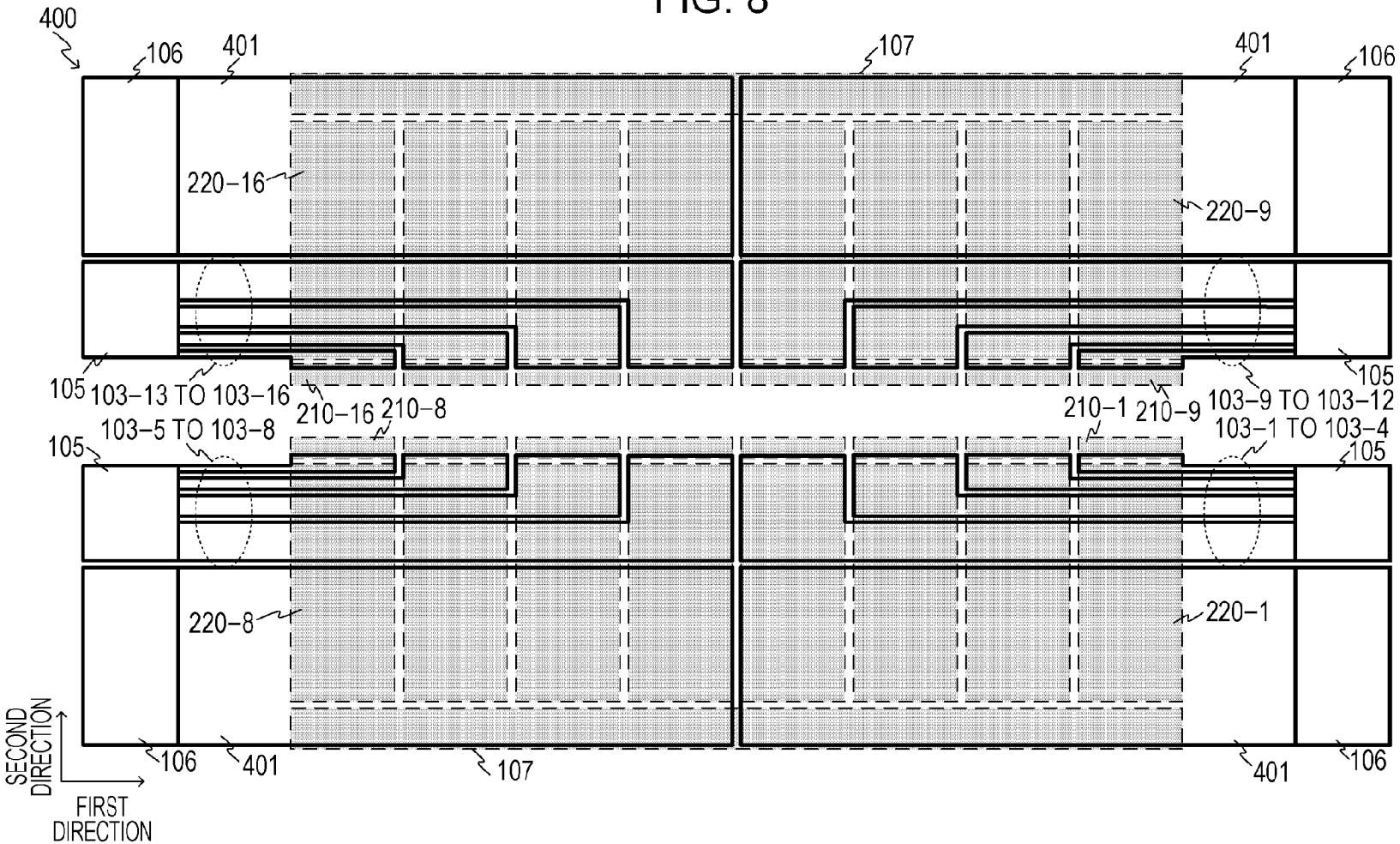
FIG. 8 is a diagram schematically illustrating the planar configuration of the liquid discharging substrate.

Next, the planar configuration of a liquid discharging substrate 400 will be described. FIG. 8 is a diagram schematically illustrating the planar configuration of the liquid discharging substrate 400. Portions which have the same functions as those in FIG. 1, 2, or 5 through 7, are denoted by the same reference numerals.

Sixteen heater regions 210 are arrayed in two rows in the first direction in the present embodiment. Eight heater regions 210-1 through 210-8 are arrayed in the first row, and eight heater regions 210-9 through 210-16 are arrayed in the second row. The layout of the first row and second row to each other is line symmetric. This configuration enables the first row and second row to share an ink supply opening, omitted from illustration. Accordingly, the size of the liquid discharging substrate 400, particularly the size in the second direction, can be reduced.

Also, multiple common conducting members 401 are provided in the present embodiment. The common conducting members 401 are each connected to different second electrodes 106 from each other. This configuration keeps a wiring loop from being formed between the liquid discharging substrate 400 and an external device. Accordingly, noise can be reduced.

As described above, both improved discharging accuracy of the liquid discharging substrate and low-voltage driving of the liquid discharging substrate can be realized according to the present embodiment, in the same way as with the first embodiment. Particularly, the size of the liquid discharging substrate can be reduced according to the present embodiment. Also, noise can be reduced according to the present embodiment.

Fifth Embodiment

Another embodiment will be described. The present embodiment differs from the first through fourth embodiments with regard to the placement of the multiple heaters. Accordingly, only points which differ from the first through fourth embodiments will be described, and description of portions which are the same as the first through fourth embodiments will be omitted.

The circuit arrangement of the present embodiment is the same as that in the second embodiment. That is to say, FIG. 5 is an equivalent circuit diagram illustrating the configuration of the present embodiment.

Figure 9:
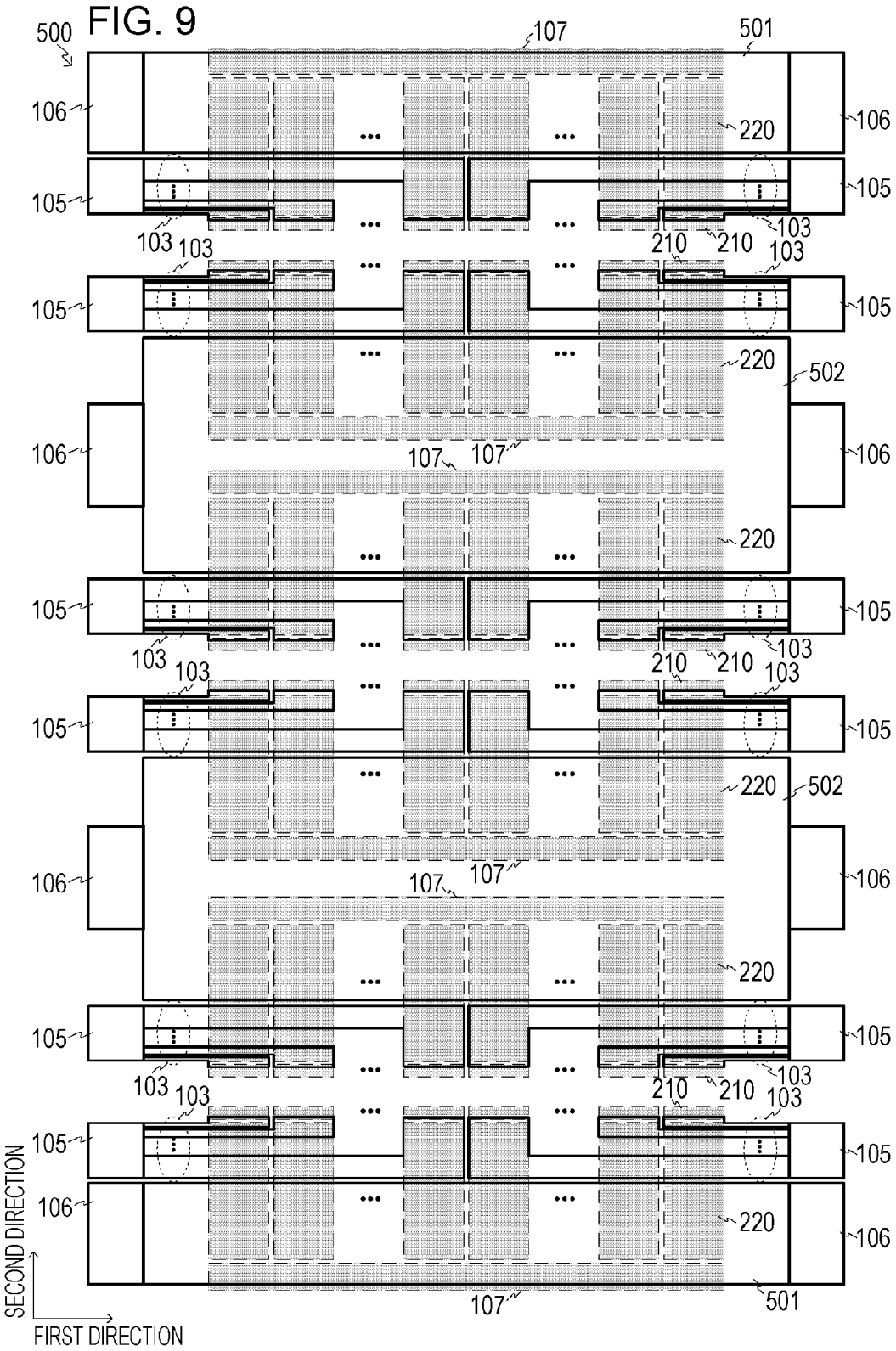
FIG. 9 is a diagram schematically illustrating the planar configuration of the liquid discharging substrate.

Next, the planar configuration of a liquid discharging substrate 500 will be described. FIG. 9 is a diagram schematically illustrating the planar configuration of the liquid discharging substrate 500. Portions which have the same functions as those in FIG. 1, 2, or 5 through 8, are denoted by the same reference numerals.

Multiple heater regions 210 are arrayed having been divided into eight rows in the first direction. This configuration enables multiple color inks to be discharged in a case where the liquid discharging substrate 500 is used in a recording apparatus, for example.

The second wiring portion 104A according to the present embodiment also includes multiple common conducting members 501 and 502. The common conducting members 502 are connected to two rows of drive element regions 220. Accordingly, the resistance of the common conducting members 502 can be easily reduced. As a result, energy can be supplied to the heaters 101 more efficiently.

As described above, both improved discharging accuracy of the liquid discharging substrate and low-voltage driving of the liquid discharging substrate can be realized according to the present embodiment, in the same way as with the first embodiment.

Sixth Embodiment

Another embodiment will be described. The present embodiment is an ink jet recording apparatus. The liquid discharging substrates described in the first through fifth embodiments can be used as the base for the recording head of the recording apparatus.

Figure 10A:
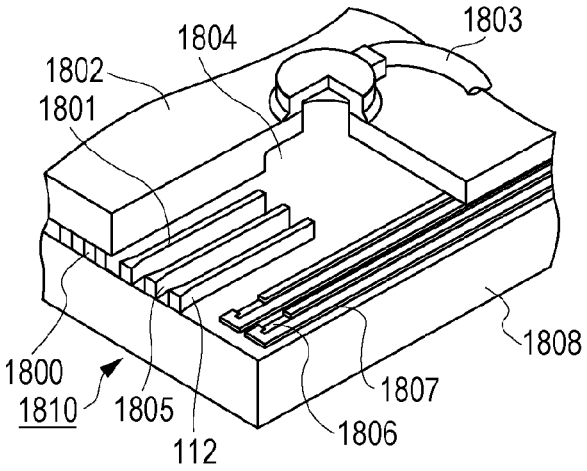
FIGS. 10A through 10D are diagrams schematically illustrating the configuration of a liquid discharging head and a recording apparatus.

FIG. 10A illustrates principal portions of a recording head 1810. The recording head 1810 includes an ink supply port 1803. The heaters 101 in the above-described embodiments are shown as heat generating units 1806. As illustrated in FIG. 10A, flow path wall members 1801 which form flow paths 1805 communicating with multiple discharge orifices 1800, and a top plate 1802 having an ink supply port 1803 are assembled to the base 1808, thus making up the recording head 1810. In this case, ink introduced from the ink supply port 1803 is accumulated in a common ink chamber 1804 and supplied to each of the flow paths 1805. The base 1808 and heat generating units 1806 are driven in this state, thereby discharging ink from the discharge orifices 1800.

Figure 10B:
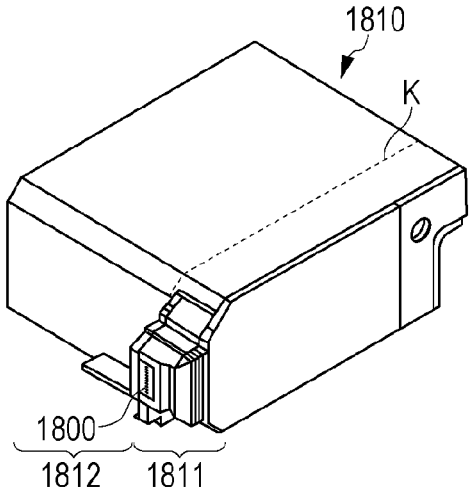

FIG. 10B is a diagram illustrating an overall configuration of this recording head 1810. The recording head 1810 includes a recording unit 1811 having the multiple discharge orifices 1800 described above, and an ink container 1812 holding into to be supplied to the recording unit 1811. The ink container 1812 is detachably mounted to the recording unit 1811 at a boundary line K. The recording head 1810 also includes electrical contacts (omitted from illustration), to receive electric signals from a carriage side when mounted to the recording apparatus illustrated in FIG. 10C. The heat generating units 1806 generate heat based on these electric signals. Fibrous or porous ink absorbing members are provided within the ink container 1812 to hold the ink, with the ink being held by these ink absorbing members.

The recording head 1810 illustrated in FIG. 10B is mounted to the main unit of the ink jet recording apparatus, and signals applied to the recording head 1810 from the main unit are controlled. This configuration enables an ink jet recording apparatus to be provided which can realize high-speed and high-image-quality recording. The ink jet recording apparatus using this recording head 1810 will be described below.

Figure 10C:
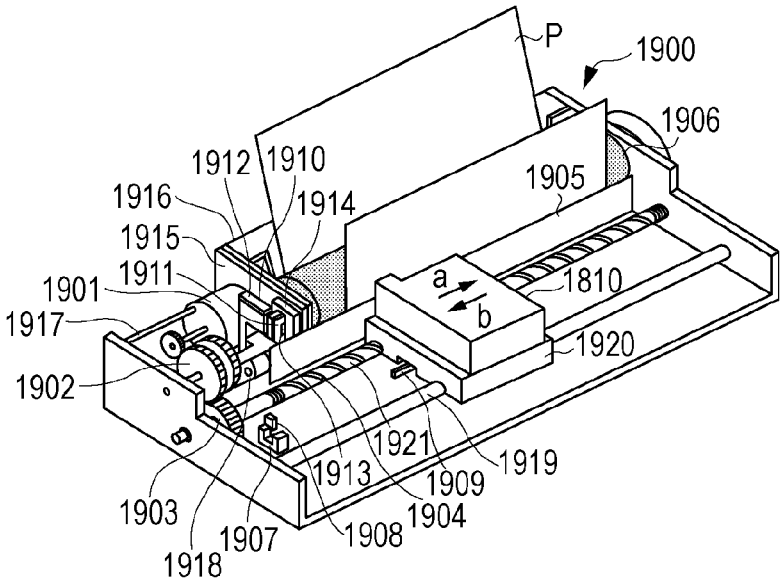

FIG. 10C is an external perspective view illustrating an ink jet recording apparatus 1900 according to the present invention. The recording head 1810 is mounted on a carriage 1920 which engages a screw groove 1921 of a lead screw 1904 that rotates along with forward and backward rotations of a driving motor 1901, through driving force transmission gears 1902 and 1903, as illustrated in FIG. 10C. This configuration enables the recording head 1810 to reciprocally move along with the carriage 1920 in the directions of the arrow a and arrow b along a guide 1919, under driving force of the driving motor 1901. A bail plate 1905 presses recording paper P, conveyed over a platen 1906 by an unshown recording medium feed device, against the platen 1906 in the direction of movement of the carriage.

Photocouplers 1907 and 1908 are provided as home position detecting units, whereby the existence of a lever 1909 provided on the carriage 1920 is confirmed in the region where the photocouplers 1907 and 1908 are provided, in order to switch the rotational direction of the driving motor 1901 and so forth. A support member 1910 supports a cap member 1911 that caps the entire face of the recording head 1810. A suctioning unit 1912 suctions within the cap member 1911 to perform suctioning recovery of the recording head 1810 through an in-cap opening 1913. A moving member 1915 enables movement of a cleaning blade 1914 back and forth, with the cleaning blade 1914 and moving member 1915 being supported by a main unit supporting plate 1916. It is needless to say that the cleaning blade 1914 is not restricted to the form illustrated in FIG. 10C, and that known cleaning blades can be applied to the present embodiment. A lever 1917 is provided to start suctioning for suctioning recovery, moving along with movement of a cam 1918 which engages the carriage 1920. Driving force from the driving motor 1901 is controlled by a known transmission mechanism such as clutch switching or the like. A recording control unit (omitted from illustration) which supplies signals to the heat generating units 1806 provided on the recording head 1810, and governs driving control of each of the mechanisms such as the driving motor 1901, is provided at the apparatus main unit side.

The ink jet recording apparatus 1900 of the configuration described above preforms recording on the recoding paper P conveyed over the platen 1906 by the recording medium feed device, by the recording head 1810 reciprocally moving over the entire width of the recording paper P. The recording head 1810 uses the liquid discharging substrate according to the above-described embodiments, so both improved ink discharging accuracy and low-voltage driving can be realized.

Figure 10D:
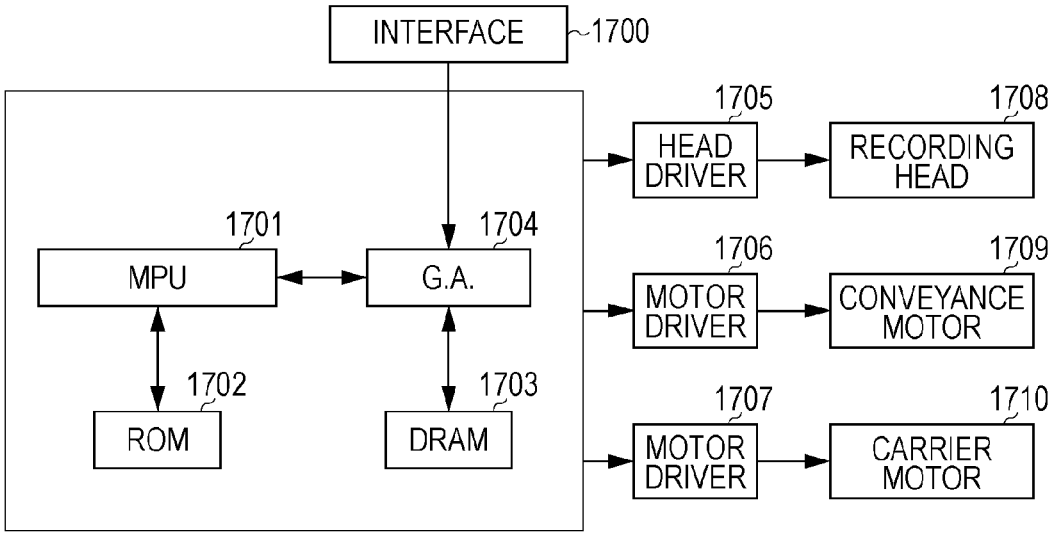

The configuration of the control circuit for executing recording control of the above-described apparatus will be described next. FIG. 10D is a block diagram illustrating the configuration of the control circuit of the ink jet recording apparatus 1900. The control circuit includes an interface 1700 where recording signals are input, a microprocessor (MPU) 1701, program read-only memory (ROM) 1702, dynamic random access memory (RAM) 1703, and a gate array 1704. The program ROM 1702 stores a control program which the MPU 1701 executes. The dynamic RAM 1703 saves various types of data, such as the above-described recording signals, recording data supplied to the head, and so forth. The gate array 1704 performs supply control of recording data as to the recording head unit 1708, and also performs data transfer control among the interface 1700, MPU 1701, and RAM 1703. The control circuit further includes a carrier motor 1710 to convey a recording head unit 1708, and a conveyance motor 1709 for conveying recording sheets. The control circuit further includes a head driver 1705 to drive the recording head unit 1708, and motor drivers 1706 and 1707 to drive the conveyance motor 1709 and carrier motor 1710, respectively.

To describe the operations of the above control configuration, when recording signals are entered to the interface 1700, the recording signals are converted into recording data for printing, between the gate array 1704 and the MPU 1701. The motor drivers 1706 and 1707 are driven, the recording head is driven according to the recording data transmitted to the head driver 1705, and printing is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-097770, filed May 9, 2014, which is hereby incorporated by reference herein in its entirety.

What is claimed is:

1. A liquid discharging substrate comprising:

a plurality of discharging elements arranged along a first direction;

a plurality of drive elements that drive the plurality of discharging elements;

a first electrode to which a first voltage is supplied;

a second electrode to which a second voltage, different from the first voltage, is supplied;

a first wiring portion electrically connecting the first electrode and the plurality of discharging elements; and a second wiring portion electrically connecting the second electrode and the plurality of drive elements, wherein the plurality of discharging elements include a first discharging element and a second discharging element, wherein the plurality of drive elements include a first drive element electrically connected to the first discharging element, and a second drive element electrically connected to the second discharging element, wherein the first wiring portion includes a first conductive member electrically connected to the first electrode and the first discharging element, and a second conductive member electrically connected to the first electrode and the second discharging element, wherein an insulating portion is formed between at least part of the first conductive member and at least part of the second conductive member, wherein the second wiring portion includes a common conductive member, which extends along a row of the plurality of discharge elements, and which is electrically connected to the second electrode, the first drive element, and the second drive element, wherein a length of the second conductive member in the first direction is longer than a length of the first conductive member in the first direction, and wherein a resistance value of the second conductive member is smaller than a resistance value of the first conductive member.

2. The liquid discharging substrate according to claim 1, wherein the length of the first conductive member in the first direction and the length of the second conductive member in the first direction are different.

3. The liquid discharging substrate according to claim 1,
wherein the plurality of discharging elements include a third discharging element,
wherein the plurality of drive elements include a third drive element electrically connected to the third discharging element,
wherein the first wiring portion includes a third conductive member electrically connected to the first electrode and the third discharging element,
wherein the common conductive member is electrically connected to the third drive element,
wherein the insulating portion includes a first insulating portion disposed between the third conductive member and the first conductive member, and a second insulating portion disposed between the third conductive member and the second conductive member,
wherein a length of the third conductive member in the first direction is longer than a length of the second conductive member in the first direction,
and wherein a resistance value of the third conductive member is smaller than a resistance value of the second conductive member.

4. The liquid discharging substrate according to claim 1,
wherein the first conductive member and the second conductive member extend in parallel along the row of the plurality of the discharging elements.

5. The liquid discharging substrate according to claim 1,
wherein the common conductive member extends in parallel to the first conductive member and the second conductive member.

6. The liquid discharging substrate according to claim 1,
wherein the common conductive member includes a first portion and a second portion,
wherein the first portion is disposed above a region where the first drive element is disposed, and electrically connected to the first drive element,
wherein the second portion is disposed above a region where the second drive element is disposed, and electrically connected to the second drive element,
and wherein the second portion is electrically connected to the second electrode via the first portion.

7. The liquid discharging substrate according to claim 1,
wherein the liquid discharging substrate has a first side in a direction where the plurality of discharging elements are arrayed, and a second side in a direction intersecting the first side,
wherein a length of the second side is shorter than a length of the first side,
and wherein the first electrode and the second electrode are arrayed along the second side.

8. The liquid discharging substrate according to claim 1,
wherein the plurality of discharging elements are arrayed divided into a plurality of segments, each segment including at least two discharging elements,
wherein the plurality of segments include a first segment including the first discharging element and a second segment including the second discharging element,
wherein the at least two discharging elements included in the first segment are electrically connected to the first conductive member,
and wherein the at least two discharging elements included in the second segment are electrically connected to the second conductive member.

9. The liquid discharging substrate according to claim 1,
wherein the plurality of discharging elements include n discharging elements, from the first discharging element through an n'th discharging element,
wherein the plurality of drive elements include n drive elements, from the first drive element through an n'th drive element, respectively electrically connected to the n discharging elements,
wherein the first wiring portion includes n conductive members from the first conductive member through an n'th conductive member, respectively electrically connected to the n discharging elements,
wherein the common conductive member is electrically connected to the n drive elements,
wherein the n conductive members respectively have a resistance value R1 through a resistance value Rn,
wherein portions of the common conductive member between two adjacent drive devices respectively have a resistance value Rs(1) through a resistance value Rs(n−1),
and wherein the resistance value R1 of the first conductive member and the resistance value Rn of the n'th conductive member satisfy the relationship $$\sum_{i=1}^{n-1} Rs_i < R1 - Rn < \sum_{i=1}^{n-1} (i \times Rs_i).$$

10. The liquid discharging substrate according to claim 1,
wherein the plurality of discharging elements include n discharging elements, from the first discharging element through an n'th discharging element,
wherein the plurality of drive elements include n drive elements, from the first drive element through an n'th drive element, respectively electrically connected to the n discharging elements,
wherein the first wiring portion includes n conductive members from the first conductive member through an n'th conductive member, respectively electrically connected to the n discharging elements,
wherein the common conductive member is electrically connected to the n drive elements,
wherein the n conductive members respectively have a resistance value R1 through a resistance value Rn,
wherein portions of the common conductive member between two adjacent drive devices each have a mutually equal resistance value Rs,
and wherein the resistance value R1 of the first conductive member and the resistance value Rn of the n'th conductive member satisfy the relationship $$(n-1)\times Rs < R1 - Rn < \tfrac{1}{2}\times n\times(n-1)\times Rs.$$

11. The liquid discharging substrate according to claim 1,
wherein the second voltage is lower that the first voltage,
wherein each of the plurality of drive elements includes an N-type transistor,
wherein one of the drain and source of the transistor is electrically connected to the discharging element,
wherein the other of the drain and source of the transistor is electrically connected to the common conductive member,
and wherein a control signal that controls the transistor is applied to the gate of the transistor.

12. The liquid discharging substrate according to claim 11,
wherein the control signal includes a signal of a third voltage that causes the transistor to conduct,
and wherein a difference between the second voltage and the third voltage is larger than the threshold voltage of the transistor, and smaller than 5 V.

13. The liquid discharging substrate according to claim 1, wherein the second voltage is higher than the first voltage, wherein each of the plurality of drive elements includes a P-type transistor, wherein one of the drain and source of the transistor is electrically connected to the discharging element, wherein the other of the drain and source of the transistor is electrically connected to the common conductive member, and wherein a control signal that controls the transistor is applied to the gate of the transistor.

14. The liquid discharging substrate according to claim 1, further comprising:

a first logic circuit; and a second logic circuit that controls the drive elements;

wherein power source voltage supplied to the first logic circuit and power source voltage supplied to the second logic circuit are equal.

15. The liquid discharging substrate according to claim 1, wherein the first conductive member and the second conductive member are included in a first wiring layer, and wherein a conductive member included in a second wiring layer that is different from the first wiring layer connects the first conductive member and the first discharging element, and also connects the second conductive member and the second discharging element.

16. The liquid discharging substrate according to claim 1, wherein the common conductive member is included in a first wiring layer, and wherein a conductive member included in a second wiring layer that is different from the first wiring layer connects the common conductive member and the first drive element and second drive element.

17. The liquid discharging substrate according to claim 1, wherein the first electrode, the first conductive member, and the second conductive member, are included in a wiring pattern integrally formed in one wiring layer.

18. The liquid discharging substrate according to claim 1, wherein the second electrode and the common conductive member are included in a wiring pattern integrally formed in one wiring layer.

19. A liquid discharging head comprising:

the liquid discharging substrate according to claim 1; and a liquid supply unit that supplies liquid to the liquid discharging substrate.

20. A recording apparatus comprising:

the liquid discharging head according to claim 19; and a driving unit that drives the liquid discharging head.

* * * * *